175-40
5/29/84 XR 4,450,906

United States Patent [19]
Firmin

[11] 4,450,906
[45] May 29, 1984

[54] APPARATUS FOR MEASURING THE WEIGHT OF THE DRILL STRING

[76] Inventor: Daniel Firmin, 215 Camelia Blvd., Lafayette, La. 70503

[21] Appl. No.: 340,987

[22] Filed: Jan. 20, 1982

[51] Int. Cl.[3] ..... E21B 49/00
[52] U.S. Cl. ..... 166/113; 175/40
[58] Field of Search ..... 166/113, 250; 175/27, 175/40; 177/208, 209, 254; 73/151

[56] References Cited

U.S. PATENT DOCUMENTS 1,993,796 3/1935 Morgan, Jr. ..... 177/208
2,551,178 5/1951 Southerland ..... 73/153
2,851,880 9/1958 Fiedler ..... 73/131 X
3,371,732 3/1968 Stein ..... 177/254

*Primary Examiner*—William E. Lyddane
*Assistant Examiner*—Joseph Falk
*Attorney, Agent, or Firm*—Charles C. Garvey, Jr.

[57] ABSTRACT

The device is an apparatus for measuring the downhole weight of a drill string. The measuring device comprises an annular expandable hydraulic cylinder having a central bore through which the tubular string can pass. A removable slip means is placed between the tubular string and the hydraulic cylinder. A gauge indicates the weight of the tubular string. The gage is responsive to a transfer of the tubular string weight to the annular hydraulic cylinder by the insertion of slips between the tubular string and the cylinder.

6 Claims, 2 Drawing Figures

APPARATUS FOR MEASURING THE WEIGHT OF THE DRILL STRING

BACKGROUND OF THE INVENTION

1. Field of the Invention

The present invention relates to an apparatus for measuring the downhole weight of a drill string. In particular, the present invention would relate to an apparatus for measuring the downhole weight of a drill string while the drill string is hung in the drill hole from the rig floor and the pressure created by an upward blowout.

2. Background of the Invention

In the process of drilling, completing and reworking oil and gas wells, tubular goods, such as drill pipe, casing and production strings, are utilized. Wells are drilled with bits attached by threaded connections on the bottom of the drill pipe. The drill pipe consists of joints of pipe approximately 30' long with threaded connections on both ends so that many joints can be screwed together to make a continuous length which is limited only by the strength of the pipe, threaded connections, and the ability of the drilling rig to handle the weight. For example, a well could be drilled to approximately 3500' deep with a bit large enough to allow 10¾" casing to be installed and cemented in the hole. The well is then drilled to bottom at approximately 10,000', with a smaller bit that will pass through the 10¾" casing. A long string of casing will then be installed or "run" in the hole from surface to 10,000' and cemented in place, leaving a steel cased hole with a cement bond as protection against influx of pressure, shales, sand, etc. from formations exposed during the drilling process. These sands, shales, and pressured zones are kept under control during drilling by the use of drilling fluid referred to as mud. The mud weight, which is controlled, balances the forces of exposed zones and strata and prevents caving in on the drill pipe or bit. The drilled cuttings are washed from the hole by using a fluid pump to move or circulate the mud down the drill pipe, through the bit, which is ported for this purpose, then back up the hole around the outside of the drill pipe inside the bored hole and/or casing, to the surface where it is separated and the mud conditioned and maintained to certain weight, viscosity and characteristics prior to re-circulation down the drill pipe. (This is a continuous uninterrupted process while working normally.)

After the well is drilled and the casings cemented in place, the producting tubing is run in the hole. Normally 3½" tubing is run in 7⅝" casing. A production packer is run in the hole first, followed by the required number of joints of tubing coupled together to reach the desired depth in the 10,000' well. The production packer is coupled to the tubing and allows a full diameter path (continuous) for circulation or movement of fluid until the packer is set. Once in position at an assumed depth of 9,900', 100' from bottom, the packer is either mechanically or hydraulically actuated forming an annular packoff or seal between the tubing and 7⅝' blocking the annular path to flow or pressure from below the packer, preventing formation pressure from being exerted on the casing when producing. The inner bore of the tubing is open and in communication through the internal bore from surface to the area below the packer. A perforating unit is then utilized to run logs and perforating guns through the tubing and into the 7⅝" casing below the packer at 9900' and somewhere above the bottom of the well at 10,000'. The logging equipment pin points the producing zone and holes are perforated in the casing at that point to allow a producing zone to flow into the well bore and up the production tubing. These tools are affixed to a stranded steel cable with electrical conductor wires in the core. The electrical wire transmits signals from the special tools to surface instruments.

After a well has been producing for a time, many events can take place. Sand, as an example, is a common problem. It can flow into the well bore with produced oil and form bridges in the tubing blocking production. Wire line units are commonly used to clear these bridges. Special bailing tools are attached to a wire line, similar to clothes line. It is spooled on a drum in a continuous length of approximately 13,000'. The tools are lowered into the well on this line and through manipulations of the line, the sand is picked up by the bailer and removed from the well, on several consecutive trips, until the tubing is cleared again for production.

There are times when a well may sand up badly and wire line is incapable of clearing large amounts of sand efficiently or economically. Concentric tubing units are then used. It is a small rig, similar to a drilling rig, but more compact and specifically designed to run small tubing or pipe, such as 1" or 1¼". The small rig runs the small pipe inside the 3½" production tubing and washes or drills the sand from the well by circulating fluid just as a drilling rig does, only on a smaller scale.

Another method of running small pipe to clean out wells is with snubbing units. The snubbing unit is a system using hydraulic jacks to raise and lower the tubing in the well. The drilling rig, concentric tubing unit, wire line unit, and logging unit all use a cable or drum and winch apparatus to run tools are tubing in and out of the hole. The snubbing unit is an exception.

The one most important function of control on all of the equipment mentioned is weight. Weight indicators must be used in order to do any of the jobs required. Drill pipe ranges in size and weight from 2⅜" to 7⅝" at 4.85 lbs per foot to 29.95 lbs. per foot covering approximately 10 sizes and approximately 30 weight ranges. (Reference Halliburton Cementing Tables. Table 212. Capacity of internal upset drill pipe at 1972 Halliburton Company.)

Tubing ranges from 1" to 4.5" with approximately 35 weight ranges. Ref: Halliburton Tables, Table #211. From 1.14 lbs pm ft to 19.20 lbs per ft.

Casing ranges from 4½" to 24½ with approximately 180 weight ranges from 9.50 lbs per foot to 113.00 lbs per foot. (These are example—there are many other combinations.)

Several factors affect the weight of a string of pipe while running in and out of a well. Some of them are: bouyancy in fluid which varies according to the density of the fluid. Sticking due to unstable hole conditions. Drag or friction in crooked holes. Solids accumulating around pipe and jamming pipe. Speed that pipe is run directly related to friction. Restrictions caused by deposits in production tubing which can jam or cause excessive drag on small pipe when running through tubing. Sudden loss of weight when pakcer or tools hang up while going in hole due to close tolerances. Sudden weight increase due to same problems when pulling pipe out of hole.

Comparable situations will also affect wire line and electric line equipment. Certain wire line tools such as plugs are set in landing nipples, in the production tubing. Wire line is used to retrieve them as well as run them initially. The wire can withstand a steady pull to about 1400 lbs without breaking. When retrieving a plug that is latched in a nipple at 8000' the required pulling tools are run in the hole. As the tools run progressively deeper, the weight of the wire in the hole increases. The weight of the tools and wire is sensed by a weight indicator on the surface. The operator views the indicator constantly. A sudden weight loss indicates a restriction or object down hole is supporting the weight of the tools. He must stop or endanger hanging the tools in a restriction where they can't be pulled free within the safe weight limits. A normal weight increase going in the hole to the plug is an indication that the tubing is clear. Prior to attaching the retrieving tools to pull the plug, the operator checks the weight by pulling the tools uphole at a constant speed. As an example his tools while moving up hole will weigh 600 lbs. While stationary they will weight 400 lbs. While moving down hole they will weight 300 lbs. The difference in the weights are due to friction. They are determined weights and are used for control. The plug is then latched and pulled on. It may be stuck and does not release with 900 or 1000 lbs pull.

The operator knows his limits and can stop pulling so as not to break his wire. If he does break the wire it can cause serious expensive work to recover it to get the well back to producing condition. If the plug pulls normally it may release at perhaps 800 lbs. 200 lbs over the "control." pull weight. After releasing the weight will return to approximately 600 lbs or perhaps a little more due to the weight or extra drag added by the plug. The wire line weight indicator is a weight cell that is attached to an anchor point near the well head. A pulley or sheave is attached to the opposite end of the weight cell and the wire line or electric line is run on this pulley. As weight increases while going in the well or pulling out of the well the tension is sensed by the weight cell and transmitted hydraulically to a weight indicator calibrated in lbs. The weight cell is basically a diaphragm with hydraulic fluid in it. When pulled on, the fluid compresses accordingly and generates pressure in lbs per square inch which indicates on the weight indicator which is a conversion from pressurre to lbs. As an example a weight cell with a diaphragm having a surface area of 10 sq. inches, would transmit 10 psi when a 100 lb load is applied. It is comparable to a hydraulic cylinder. A piston with 10 sq. inches of effective area would move 100 lbs when 10 psi hydraulic pressure is applied. Or in reverse a weight of 100 lbs or equivalent force would compress the hydraulic fluid to 10 psi. All of the equipment used to run pipe wire line, or electric line uses similar weight indicators. Some indicators may read tension on cable, or stretch. Nevertheless, some method is used.

On a hydraulic snubbing unit that moves the pipe, with the hydraulic cylinders, there are no cables involved where a conventional weight ind. can be installed. The method of reading the weight of a string of pipe is to take the pressure appied to the cylinders to move the load and convert that to weight. The mainfolding, valving, and speed of operation all affect the accuracy of the weight indications. The weight will indicate differently just by the difference in operators. The speed or control lever must be actuated simply to move the pipe in order to get a reasonable indication. Due to loss of fluid through internal checks and the bleed off on the jack cylinders, it is almost impossible to read "hanging" weight. Weight indicators on hydraulic units are notorious for being inaccurate which has on a number of occasions proved to be expensive. Tubing has been pulled in two by exceeding its limits due to inaccurate indicators. The recovery of this tubing is difficult and time consuming. Lack of sensitivity in low weight ranges causes lots of lost time, by not knowing what is taking place down hole. The small tubing is often used to retrieve wire line tools or plugs that wire line does not have the strength to handle. It takes approximately 8 hours to run 10,000' of 1" pipe in the well. After latching a plug and pulling it free, the operator does not know whether he pulled the plug, or the pulling tool malfunctioned and slipped off the plug. The weight indicator can not sense the lighter weights. A trip out of the hole is necessary to see if it has been effectively latched. If not, the time is wasted. A dependable, sensitive indicator is needed. One that is independent of the snubbing unit hydraulic system. There have been apparatuses which have been developed in the oil field which attempt to measure the weight of the drill string as it is hanging in the hole. For the most part, these apparatuses would attempt to measure indirectly the weight of the drill string through the pressure incurred by the drill string around the hole. Such a method of measurement has been at best inaccurate and has yet to achieve the complete accuracy that one must achieve in order to obtain the exact weight of the string.

Several patents speak to a type of measuring apparatus, and these are as follows:

| |
|---|
| 1,610,872 - J. W. Macclatchie |
| 1,755,849 - C. V. Temple |
| 1,771,340 - W. R. Martin |
| 1,949,908 - W. L. Hawk |
| 1,993,796 - J. S. Morgan, Jr. |
| 2,091,502 - J. A. Indicott |
| 2,189,552 - H. A. Raphael |
| 2,235,279 - F. S. Bunker |
| 2,260,401 - H. A. Raphael |
| 2,277,925 - J. W. Mcclatchie et al |
| 2,304,402 - D. S. Faulkner |
| 2,349,228 - P. A. Wolff |
| 2,488,070 - J. D. Spalding |
| 2,529,883 - J. T. Hayward |
| 2,551,178 - S. W. Sutherland |
| 2,696,111 - R. E. Conner |
| 2,703,008 - A. J. Seljos et al |
| 2,741,915 - H. J. Renkin et al |
| 2,765,654 - C. B. Greer et al |
| 2,851,880 - W. M. Fiedler |
| 2,983,140 - F. S. Crain |
| 3,004,426 - E. Lodynski |
| 3,115,036 - A. L. Guthner |
| 3,499,324 - J. Wenisch |
| 4,236,408 - S. E. Corry |

U.S. Pat. No. 1,585,634 issued to D. F. Axelson entitled "Load Indicator" would teach the use of providing a means which will make evident any abnormal or load condition of a pump during the oil drilling process. It would include a pump having a plunger, means for reciprocating the plunger and means associated with the plunger for indicating the weight on the plunger.

U.S. Pat. No. 3,359,791 issued to R. A. Pantages entitled "System Responsive to Well Pumping Loads" would teach an improved system responsive to prolonged operation of a pumping well at below capacity level as determined by the failure of the load on the pump ride to reach normal, high or low values in a predetermined period of operation.

3. Summary of the Present Invention

The present invention would solve the problem incurred in the present state of the art in a simple and straight-forward manner. What is provided is a double acting cylinder which would comprise a cylinder space portion which further comprises a pair of cylinder walls, the interior and exterior wall forming an annular cylinder space between the walls. The cylinder walls would be integrally and sealably connected to a cylinder floor portion on the lowermost end, and the upper end, each cylinder wall providing an inwardly directed shoulder portion for sealably engaging a piston body there between, with the cylinder space within the cylinder providing a sealed space for containing cylinder fluid there within.

In the preferred embodiment, the interior cylinder wall would provide an annular opening and would allow for the passage of pipe there through as the drill pipe moved down the drill hole. The annular cylinder section would be rigidly attached to the drill floor, preferably to the base of the floor upon which the slips would normally be attached, and would therefore be in the position to effectively support the string of pipe hung in the drill hole. Contained within the annular space would be an annular piston or the like, the foot of which would substantially conform to the annular space between the cylinder walls, and integrallly attached to the upper piston body which would be of a reduced thickness in the foot of the piston, for allowing cylinder fluid between the wall of the piston body and the walls of the cylinder. Provided in the annular space between the lowermost end of the piston foot and the floor of the annular cylinder would be a predetermined quantity of hydraulic fluid or the like which would fill the void between the bottom portion of the foot of the piston and the floor of the cylinder. The fluid would be retained within that space by a series of O rings or the like between the foot of the piston and the cylinder walls. Upon pressure placed upon the fluid within the space, the fluid would be pressurized into a fluid line for activating a gauge or the like and providing a read-out on the amount of pressure placed down upon the fluid due to the weight of the drill string hung in the hole. There is further provided a second quantity of hydraulic fluid or the like contained in the annular space between the narrowed wall of the piston body and the walls of the cylinder in that space between the upermost portion of the cylinder foot and the shoulder portions of the cylinder walls. The fluid in the uppermost chamber would be contained within the chamber by a series of O rings or the like between the wall of the piston body and the annular shoulder portions. Therefore, upon exerting upward pressure on the drill string, due to an on coming blow-out or the like, the upward movement of the piston would provide pressurized fluid to move into a second line for activating a second gauge for read-out of the pressure exerted upon the piston in an upward direction.

BRIEF DESCRIPTION OF THE DRAWINGS

For further understanding of the nature and object of the present invention, reference should be had to the following detailed description taken in conjunction with the accompanying drawings in which like parts are given like reference numerals and wherein.

DETAILED DESCRIPTION OF THE PREFERRED EMBODIMENT

Figure 2:
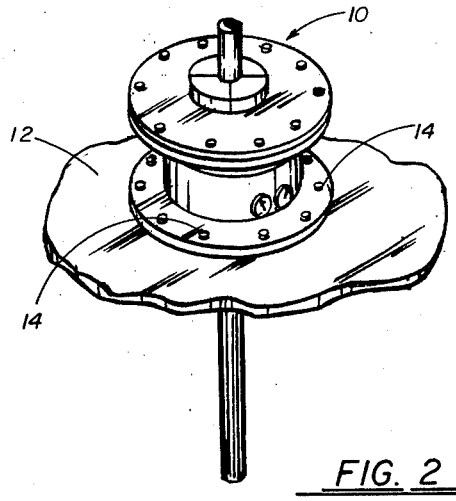
FIG. 2 is an overall perspective view of the preferred embodiment of the apparatus of the present invention mounted on the rig floor.
Figure 1:
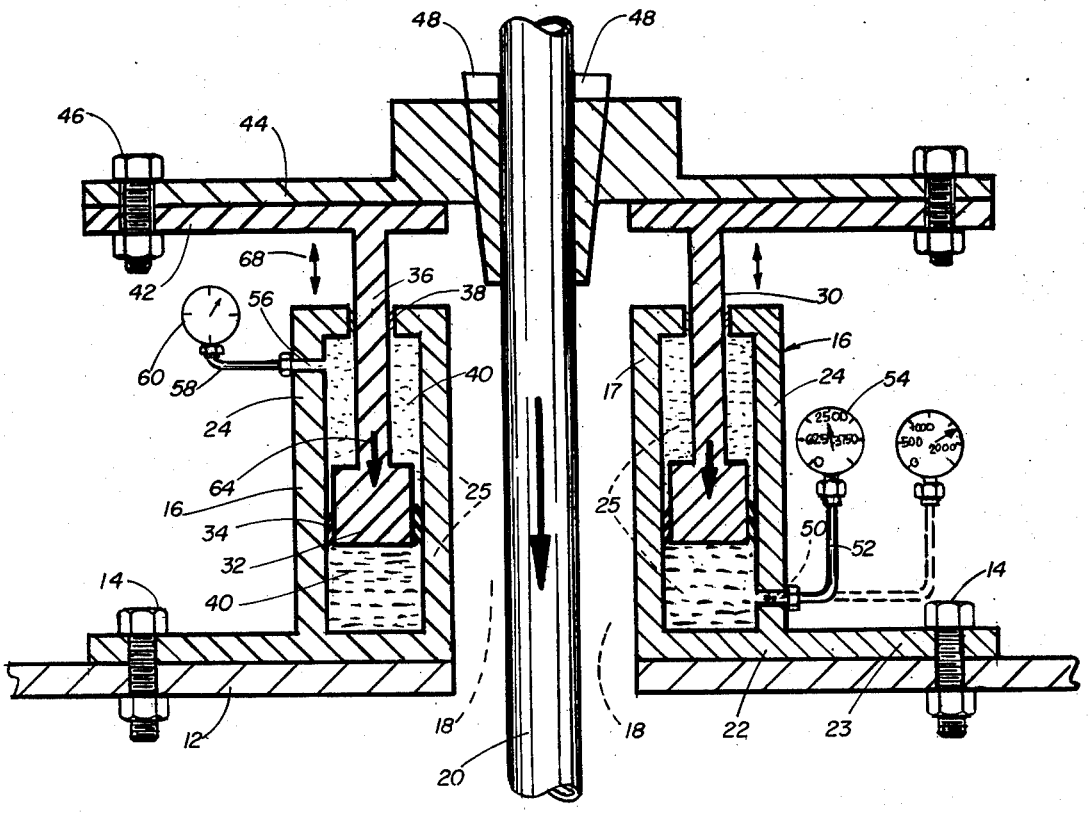
FIG. 1 is a cross sectional view of the preferred embodiment of the apparatus of the present invention.

FIGS. 1 and 2 best illustrate the preferred embodiment of the apparatus of the present invention designated generally by numeral 10. In FIGS. 1 and 2 there can be seen apparatus 10 as illustrated in FIGS. 1 and 2 mounted on drill floor 12 by a plurality of bolts or the like 14. As seen in cross-sectional view in FIG. 1, apparatus 10 would generally comprise an annular cylinder portion 16 which would be mounted securely to the drill floor 12, in the preferred embodiment. Annular cylinder 16 would have an inner annular cylinder wall 17 which would be a continuous annular wall and would form an annular space 18 within for easy passage or drill pipe 20 through annular space 18. Drill pipe 20 would be a standard 4" drill pipe utilized in drilling under normal operations. Inner annular wall 17 would be integrally attached at its lower most end to bottom portion 22 which would extend perpendicular from annular wall 17 and in parallel relation to drilling platform floor 12 being mounted flush thereupon. In the preferred embodiment, bottom portion 22 would extend outward to shoulder portion 23, for mounting cylinder 16 onto drill floor 12, as can be seen in side view in FIG. 1 via mounting bolts 14. Cylinder portion 16 would further comprise outer annular wall 24 which would extend upward from integrally attachment with bottom portion 22, and would be substantially of equal height of inner wall portion 17. The inter space 25 between inner and outer walls 17 and 24 respectively would form cylinder space 25 in the preferred embodiment.

Further illustrated in FIGS. 1 and 2 is annular piston means 30. Annular piston means 30 would provide for foot portion 32 which would conform substantially to the annular space defined by cylinder walls 17 and 24 respectively. Annular foot portion 32 would have the ability to move within the cylinder space 25, but would be sealably and slidably engaged against the walls 17 and 24 of the cylinder space by a series of O rings or the like 34 which would provide a primary seal means between the foot portion 32 of piston 30 and walls 17 and 24, to disallow any hydraulic fluid 40 contained between the bottom portion of foot portion 32 and the floor portion 22 of cylinder 16 from moving into the upper portion of cylinder space 25 above foot means 32.

Foot portion 32 would converge at its uppermost end to narrowed piston body portion 36 which would be substantially an annular wall integrally connected to the uppermost end of foot portion 32 and extended upward through the uppermost opening in cylinder 16. Because the cylinder body 36 is more narrow than foot portion 32, there is therefore provided a space between the walls of piston body 36 and the interior wall 17 and exterior wall 24 of cylinder 16. Contained within that space provided thereby would be a second portion of hydraulic fluid 40 which would also be disallowed from moving into the lowermost portion of the cylinder space 25 by O rings 34 on the lowermost end, and would be disallowed from moving out of the cylinder space of the upper end, due to the second primary sealing means 38 which comprises a plurality of O rings or the like sealably engaged between the wall of piston body 36 at the uppermost end portion of cylinder 16.

The uppermost end of piston body 36 would be integrally attached to horizontally extending base portion 42 which would serve as a mounting for top portion 44, which would be sealably mounted to base portion 42 via a plurality of bolts 46. Base portion 42 in combination with top portion 44 would serve as a means for providing support for slips 48 as the drill pipe 20 is hung within the drill hole, the slips disallowing slippage of the pipe further down within the hole and serving to engage the pipe within the hole as it is hung in the hole. In the operation of the apparatus 10, there is further provide port 50 which would allow hydraulic fluid 40 contained beneath the foot portion 32 of piston 30 to be pressurized into line 52, the pressurized hydraulic fluid through line 52 activating read-out means 54 which would be a gauge or the like for reading out the pressure placed upon hydraulid fluid 54 during the operation of the apparatus. Likewise, there is further provided a second port 56 which would allow pressurized hydraulic fluid 40 contained in the annular cylinder space between foot 32 and the uppermost portion of cylinder 30, to be pressurized into line 58 which would likewise activate read-out means 60 which is a second gauge or the like for recording pressure exerted on the piston 30 in an upward direction from within the hole.

In the operation of the apparatus, apparatus 10 would be mounted on drill floor 12, as illustrated in FIG. 2, with piston means 30 contained within annular cylinder space 25 as illustrated in FIG. 2. Drill pipe 20 would then by rigidly engaged to uppermost portion 44 of the apparatus 10, via the slips 48, and, therefore, the weight of the drill string would be supported by slips 48 in rigid engagement with apparatus 10.

Upon the pressure exerted by the weight of drill string 20, which would be in hundreds of thousands of pounds in most cases, piston 30 would consequently be forced downward as indicated by arrows 64 thus exerting tremendous pressure upon that hydraulic fluid 40 in that space defined by the lowermost end of piston foot 32 and floor portion 22 of cylinder 16. The exertion of that pressure upon hydraulic fluid 40 would force the fluid through port 50 into line 52 and activating gauge 54 for producing a read-out upon gauge 54 which would be convertible into pounds of pressure exerted per square inch, depending on the size of drill pipe hung within the hole. See table 1 below. In this way, the total weight of the drill string hung within the hole could be determined off of the recording means 54 with a minimum of guess work or estimation involved, and the read-out would be immediate and accurate.

Further provided in the operation, is the read-out of pressure exerted from within the hold upward through the drill string which would tend to lead a blow-out or the like during operations. In that event, with piston 30 seated within the cylinder space 25, there would be provided "traveling slips" which are used to prevent the drill pipe from coming out of the hole during the operation of "snubbing", i.e., forcing the drill pipe down into a hole under pressurized or live wells. In order to accurately obtain information as to the amount of pressure being exerted on the drill pipe during this snubbing operation, there would be provided the set or traveling slips which would prevent the drill pipe from moving upward, and thus the pressure exerted on the drill pipe would likewise force the apparatus 10, or piston 30 upward through the cylinder space. Therefore, the hydraulic fluid 40 contained in that area of the cylinder space defined by the inner wall of the cylinder and the walls of the piston body would be forced upward and, pressurized as the piston moved upward as indicated by arrow 66. Upon the pressurization of hydraulic fluid 40 with this upward movement, hydraulic fluid 40 would be pressurized into line 58 through port 56 and would activate recording means 60 which would indicate the amount of pressure being exerted on the drill pipe as it is being forced down the hole. Therefore, during the "snubbing" process, an accurate and ongoing read-out of the pressure being exerted against the drill pipe would be obtainable which, under the present state of the art, is not obtainable at this point.

Therefore, what is provided in apparatus 10 is a unit which would measure both the down hole weight of the tool of the drill pipe 20 as it is being hung in the drill hole, and, also have the ability during the snubbing process to measure the pressure exerted against the drill pipe as it is being forced down the hole under pressure. This combination of aspects of measurement provided by this apparatus is new in the art, and provides an effective and accurate means for assuring the forces upon which the force is being exerted against the drill pipe during the drilling and production of the well.

CONVERSION CHART AND EXAMPLES
16" diameter outside circle = 201 sq. inches

| | |
|---|---|
| 3" hole = 7.07 sq. in. | 201 - 7.07 = 193.93 sq. in. |
| 4" hole = 12.57 | 201 - 12.57 = 188.43 |
| 5" hole = 19.63 | 201 - 19.63 = 181.37 |
| 6" hole = 28.27 | 201 - 28.27 = 172.73 |
| 7" hole = 38.48 | 201 - 38.48 = 162.52 |
| 8" hole = 50.26 | 201 - 50.26 = 150.74 |
| 1st Example | |
| 16" Outside | |
| 200,000 lbs. ÷ 193.93 sq. in. | = 1031.20 psi 3" hole |
| 200,000 lbs. ÷ 150.74 sq. in. | = 1326.78 psi 8" hole |
| 2nd Example | |
| 14" Outside = 153.93 | |
| 3" hole = 146.86 > 200,000 lbs. | = 1361.84 psi |
| 8" hole = 103.67 | = 1929.19 |
| 3rd Example | |
| 12" Outside = 113.09 | |
| 3" hole = 106.02 > 200,000 lbs. | = 1886.43 psi |
| 8" hole = 62.83 | = 3183.19 psi |

Therefore, as is seen in the above chart, if one were to have a 16" diameter outside, that would be exacly 201 square inches. If one were to have a 3" hole that would be a total of 7.07 square inches. The 201 square inches less than the 7.07 square inches would equal 193.93 square inches of area. If there were 200 thousand pounds of weight exerted on that 193.93 square inch area, the pounds per square inch would total to 1,031.29 pounds per square inch exerted. Therefore, from the apparatus as detailed in this application, one would want to have 200,000 pounds of weight of drill string, one could easily determine that weight from a direct read-out as provided, and easily convert that weight to pounds per square inch and therefore has a constant reading knowledge of the pounds per square inch exerted by the drill string. Therefore, one would know at all times what type of force is being exerted on the uppermost section of drill pipe.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for measuring the weight of tubular string lowered into a well, comprising:
   a. annular expandable hydraulic cylinder means having a central bore through which the tubular string can freely pass for temporarily supporting the tubular string at least when its weight is to be determined;
   b. removable slip means placeable between the tubular string and the annular expandable hydraulic cylinder means for forming a load transfer interface between the tubular string and the expandable hydraulic cylinder means when the tubular string weight is to be measured; and
   c. guage means hydraulically connected to the annular expandable hydraulic cylinder means for indicating weight of the tubular string response to a transfer of the tubular string weight to the annular expandable hydraulic cylinder means by insertion of the removable slips between the tubular string and cylinder means.

2. The apparatus of claim 1, wherein said expandable hydraulic cylinder means defines a substantially cylindrical space, coaxially aligned with the tubing string inserted thereinto.

3. An apparatus for measuring the pressure exerted against a tubular string lowered into a well, comprising:
   a. cylinder means having an inner annular wall and an outer annular wall, the space between said inner and outer walls defining a cylinder space therebetween;
   b. piston means movably disposed within said cylinder space
   c. hydraulic fluid means contained within the cylinder space for sensing load from the piston means;
   d. weight indicating means communicating with said fluid means for indicating the weight of a load supported by the piston means; and
   e. removable means for supporting said tubular string with said piston means.

4. The apparatus of claim 3, wherein the inner wall of said cylinder means defines a substantially cylindrical space, coaxially aligned with the tubing string allowing insertion of the tubing string therethrough, as during vertical movement of the tubing string with respect to the piston means.

5. The apparatus of claim 3, wherein said cylinder means is mounted on and attached to a section of a hydraulic snubbing unit.

6. An apparatus for measuring the dead weight of a string of pipe joints hung within a drill hole and measuring the pressure exerted on drill pipe from within the hole, which comprises:
   a. a substantially annular cylinder means, mounted and rigidly attached to the drill floor, said cylinder means comprising:
      i. a first annular inner cylinder wall, the inner side of said wall defining an annular space for movement of drill pipe there through;
      ii. a second annular outer cylinder wall, the inner surface of said outer wall and inner surface of said inner wall, defining an annular cylinder space there between;
      iii. floor portion integrally connecting said inner and outer annular walls, to define a fluid containing cylinder space there within;
      iv. a first and second shoulder portions directed inward from the top end of said inner and outer annular walls, said shoulder portions defining fluid retaining area within said cylinder space;
   b. piston means, which comprises:
      i. a piston foot portion, said foot portion conforming substantially to the cylinder space and forming a fluid type seal between the outer wall of said piston foot portion and the inner sides of said cylinder walls;
      ii. a reduced body portion integrally attached and extending from the upper portion of said foot portion through a space defined by said shoulder portions and exterior to said cylinder space, there being provided a fluid tight seal between the walls of said body portion and the walls of said annular shoulders;
   c. first sealing means between said foot of said piston and said cylinder walls for containing hydraulic fluid between the bottom of said foot portion and the floor of said cylinder;
   d. a second seal means between the wall of said piston body and the wall of said annular shoulder portions, for maintaining hydraulic fluid in that space defined by the uppermost portion of the piston foot and the uppermost portion of the cylinder body;
   e. first recording means for recording the pressure exerted on said hydraulic fluid between the foot portion and the floor of the cylinder body;
   f. second recording means for recording the pressure exerted on the hydraulic fluid between the upper portion of the foot portion and the top portion of the cylinder body;
   g. means for frictionally engaging said pipe and said piston means so that the entire weight of said drill string is resting upon said piston means;
   h. means for frictionally engaging said pipe in said piston means so that the entire pressure exerted upward on said pipe is established by said piston means.

* * * * *